US006665924B2

(12) United States Patent
Schütz

(10) Patent No.: US 6,665,924 B2
(45) Date of Patent: Dec. 23, 2003

(54) CENTRIFUGE HAVING A SPRING-LOADED NUT FOR SECURING A ROTOR TO A DRIVE CONE

(75) Inventor: Klaus Schütz, Osterode/Harz (DE)

(73) Assignee: Kendro Laboratory Products, L.P., Newtown, CT (US)

( * ) Notice: Subject to any disclaimer, the term of this patent is extended or adjusted under 35 U.S.C. 154(b) by 17 days.

(21) Appl. No.: 10/056,953

(22) Filed: Jan. 25, 2002

(65) Prior Publication Data

US 2003/0144124 A1 Jul. 31, 2003

(51) Int. Cl.[7] ..... B04B 7/06; B04B 5/02

(52) U.S. Cl. ..... 29/525.11; 494/12; 494/16

(58) Field of Search ..... 494/12, 16, 20, 494/33, 64, 84, 85; 210/232; 29/434, 525.11

(56) References Cited

U.S. PATENT DOCUMENTS

| | | | | |
|---|---|---|---|---|
| 3,696,913 | A | * | 10/1972 | Anders |
| 3,819,111 | A | * | 6/1974 | Romanauskas et al. |
| 3,843,045 | A | * | 10/1974 | Schmidt et al. |
| 3,961,745 | A | * | 6/1976 | Wright |
| 4,010,890 | A | * | 3/1977 | Wright |
| 4,344,563 | A | * | 8/1982 | Romanauskas |
| 4,360,151 | A | * | 11/1982 | Cowell et al. |
| 4,412,830 | A | * | 11/1983 | Strain et al. |
| 4,435,169 | A | * | 3/1984 | Romanauskas |
| 4,753,631 | A | * | 6/1988 | Romanauskas |
| 4,850,951 | A | * | 7/1989 | Cheng et al. |
| 5,344,380 | A | * | 9/1994 | Chern et al. |
| 5,512,030 | A | * | 4/1996 | Barkus |
| 5,558,616 | A | * | 9/1996 | Barkus et al. |
| 5,681,257 | A | * | 10/1997 | Letourneur |
| 5,897,482 | A | * | 4/1999 | Lowe |
| 6,063,018 | A | * | 5/2000 | Letourneur |
| 6,149,570 | A | * | 11/2000 | Lowe et al. |

FOREIGN PATENT DOCUMENTS

| | | | |
|---|---|---|---|
| DE | 3334655 A1 | * | 4/1985 |
| DE | 3805894 C1 | * | 3/1989 |
| DE | 3805896 C1 | * | 3/1989 |
| JP | 58-6257 | * | 1/1983 |
| JP | 7-284695 | * | 10/1995 |
| JP | 7-328486 | * | 12/1995 |

* cited by examiner

*Primary Examiner*—Charles E. Cooley
(74) *Attorney, Agent, or Firm*—Baker & Hostetler LLP

(57) ABSTRACT

A method and apparatus for securing a rotor to a drive cone in a centrifuge includes positioning a rotor upon a drive cone and providing a nut movable in an axial direction in the drive cone. A screw passing through a region of the rotor engages the nut, and a spring is located between a surface of the nut and a surface of the drive cone. By tightening the screw into the nut, the nut moves in an axial direction to compress the spring between the surface of the nut and the surface of the drive cone. The arrangement of the screw, nut, and spring prevents a loosening of the screw from the nut during operation of the centrifuge.

20 Claims, 3 Drawing Sheets

CENTRIFUGE HAVING A SPRING-LOADED NUT FOR SECURING A ROTOR TO A DRIVE CONE

The present invention relates to a centrifuge instrument, and more particularly, to a centrifuge in which a rotor hold-down screw, a nut and a spring are arranged to secure a rotor to a drive cone.

BACKGROUND OF THE INVENTION

A centrifuge instrument is a device by which a liquid sample may be subjected to a centrifugal force that separates the liquid sample into its constituent parts. The sample is typically carried in a tube situated within a member known as a centrifuge rotor. The rotor is mounted on a drive cone, which is connected to a drive shaft that provides a source of motive energy to rotate the rotor.

The centrifugal force that advantageously acts upon the sample also acts upon the rotor that holds the sample. If the rotor separates from the drive cone during centrifuge operation, it could damage the centrifuge instrument. If the rotor is thrown from the centrifuge instrument, it could damage external equipment or injure a person in the vicinity of the instrument. Accordingly, the rotor must be adequately secured to the drive cone.

The mounting of the rotor to the drive cone is typically accomplished by way of a rotor hold-down screw. A central region of the rotor rests upon the drive cone. The rotor hold-down screw is routed through a cover hold-down screw knob and the central region of the rotor, and tightened into a threaded channel in the drive cone. That is, the rotor hold-down screw is threaded directly into the drive cone. To better secure this arrangement, a lock washer is sometimes placed between a lower surface of the rotor hold-down screw and an upper surface of the cover hold-down screw knob.

As compared with an older centrifuge instrument, a newer centrifuge instrument typically has a stronger motor, better drive design, and a more powerful refrigeration system. These features of the newer instrument provide the operator with the advantages of faster acceleration and deceleration, an ability to run the rotor with a greater degree of imbalance, and a possibility of having a colder rotor chamber temperature.

The centrifuge instrument may accept any one of a plurality of different centrifuge rotors depending upon the separation protocol being performed, and it is not uncommon for an operator to use an old rotor on a new centrifuge instrument. However, the capability of the new instrument to more rapidly change its speed and temperature, and to operate with a greater degree of imbalance, also increases the chance for the rotor hold-down screw to become loosened, and thus increase the opportunity for the rotor to become separated from the drive cone.

The present invention provides an improved arrangement for securing a rotor to a drive cone in a centrifuge instrument, and is suitable for an environment in which the centrifuge speed or temperature are rapidly changed.

SUMMARY OF THE INVENTION

An apparatus for securing a rotor to a drive cone in a centrifuge includes (a) a nut, movable in an axial direction in the drive cone, (b) a screw, for passing through a region of the rotor and for engagement with the nut, and (c) a spring located between a surface of the nut and a surface of the drive cone. The screw, when tightened into the nut, moves the nut in the axial direction to compresses the spring between the surface of the nut and the surface of the drive cone. The nut may include a protrusion that fits into a slot in the drive cone to limit rotation of the nut with respect to the drive cone. The spring can be any of a double-spring washer, a compression spring, a disc spring or a belleville spring washer.

The apparatus can also include a retaining ring for holding the nut and the spring in the drive cone. Such a retaining ring is located adjacent to a perimeter region of the nut, within an annular groove of the drive cone.

A preferred embodiment of the present invention is an apparatus for securing a rotor to a drive cone in a centrifuge, where the apparatus includes (a) a nut, movable in an axial direction in the drive cone, (b) a screw for passing through the rotor and for engagement with the nut, (c) a spring located between a surface of the nut and a surface of the drive cone, and (d) a retaining ring for holding the nut and the spring in the drive cone. The retaining ring is located adjacent to a perimeter region of the nut, within an annular groove of the drive cone. The screw, when tightened into the nut, moves the nut in the axial direction to compress the spring between the surface of the nut and the surface of the drive cone. The nut has a protrusion that fits into a slot in the drive cone to limit rotation of the nut with respect to the drive cone.

DESCRIPTION OF THE INVENTION

Figure 1:
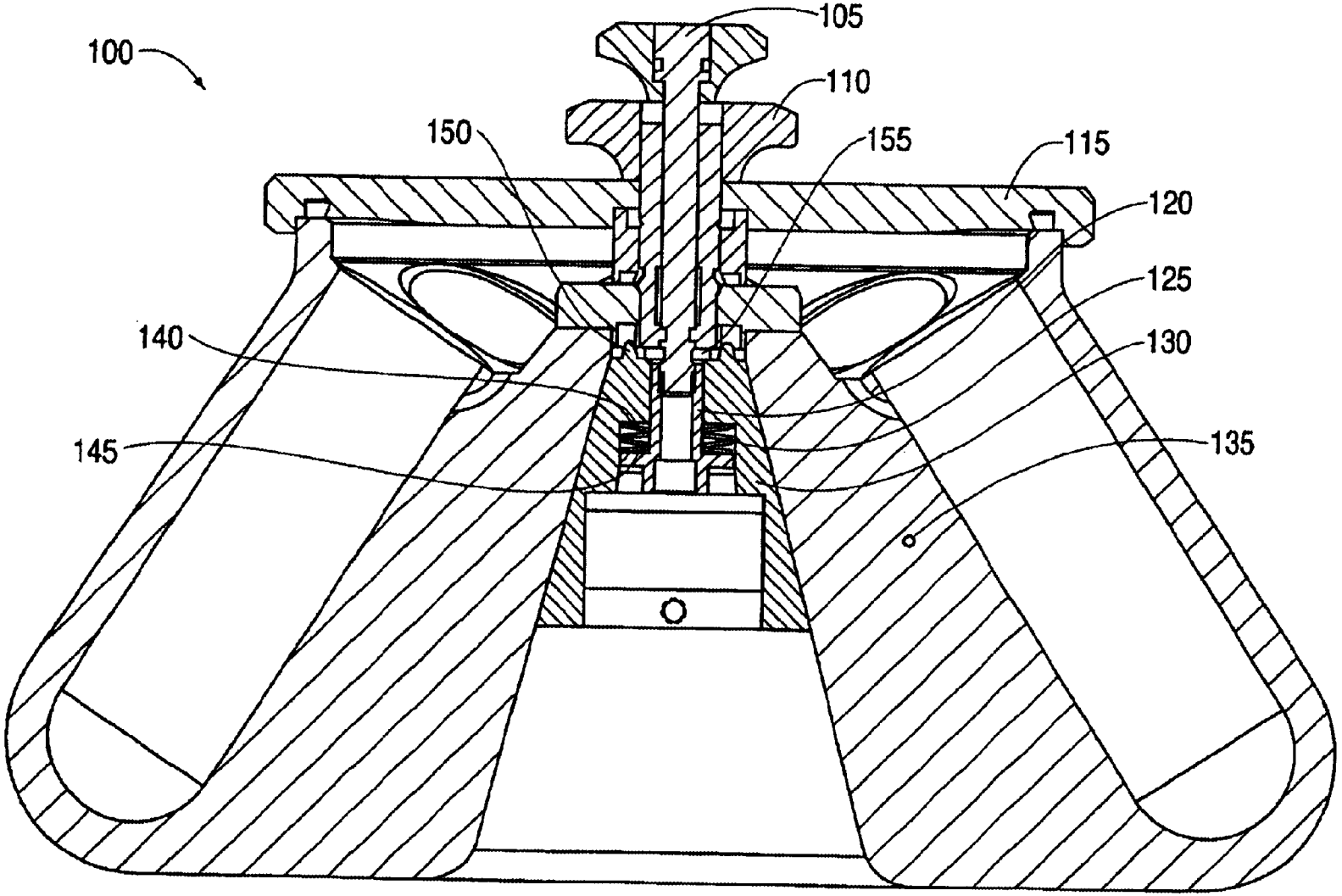
FIG. 1 is a cross section of a centrifuge instrument having a rotor secured to a drive cone in accordance with the present invention.

FIG. 1 is a cross section of a centrifuge 100 having a rotor 135 adapted for holding at least one sample secured to a drive cone 130 in accordance with the present invention. Centrifuge 100 includes a rotor hold-down screw 105, a cover hold-down screw 110, a cover 115, a nut 120, and a spring 125.

Rotor 135 sits upon drive cone 130. Cover 115 is placed over rotor 135 and held in place by cover hold-down screw 110. Rotor hold-down screw 105 is routed or passed through cover hold-down screw 110, cover 115, and a central region of rotor 135 and tightened into nut 120. An o-ring 155 holds cover hold-down screw 110 and rotor hold-down screw 105 in place on cover 115. Thus, o-ring 155 holds cover 115, cover hold-down screw 110, and rotor hold-down screw 105 together as an assembly.

Spring 125 is positioned between a surface 140 of drive cone 130, and a surface 145 of nut 120. Rotor 135 is secured to drive cone 130 through a cooperative arrangement of rotor hold-down screw 105, nut 120 and spring 125. During operation of centrifuge 100, a rotational force is provided by a motor (not shown) that causes drive cone 130 to rotate. The rotational force is transferred from drive cone 130 through drive pins 150 to rotor 135.

Spring 125 can be implemented as one or more spring elements, or a series of springs, for example, as two spring elements arranged back-to-back. Suitable spring elements include, but are not limited to, a double-spring washer, a compression spring, a disc spring or a belleville spring washer. The belleville spring washer is preferred because it provides very high loads in a confined space, e.g., the space between surface 140 and surface 145.

Figure 2:
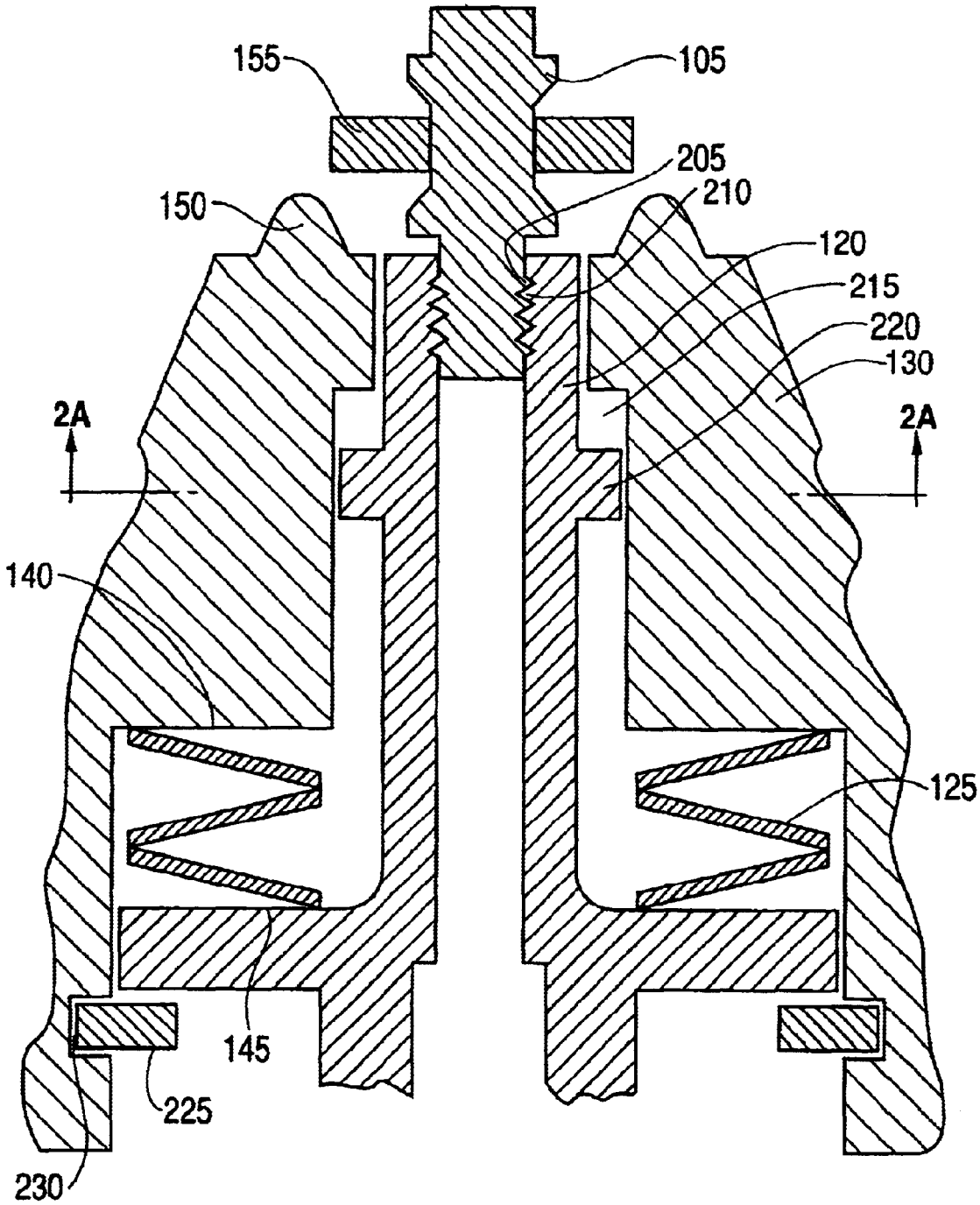
FIG. 2 is a cross section of the centrifuge of FIG. 1 showing a detailed view of an arrangement of a rotor hold-down screw and a nut.

FIG. 2 is a cross section of centrifuge 100 showing in detail the arrangement of rotor hold-down screw 105 and nut 120. During assembly of centrifuge 100, spring 125 is pre-loaded into drive cone 130, nut 120 is inserted and a retaining ring 225 is installed adjacent to a perimeter region of nut 120 in an annular groove 230 in drive cone 130 to hold spring 125 and nut 120 in place.

Rotor hold-down screw 105 has threads 205 that engage corresponding threads 210 in nut 120. Assume that rotor hold-down screw 105 is left-hand threaded, so that when it is rotated counter-clockwise threads 205 more fully engage threads 210 and rotor hold-down screw 105 is tightened into nut 120. Nut 120 is movable in an axial direction, e.g., up and down in FIG. 2. Tightening of rotor hold-down screw 105 draws nut 120 upward and compresses spring 125 between surfaces 140 and 145. Spring 125 opposes the compression and attempts to expand, thus exerting a force that has a tendency to lock rotor hold-down screw 105, nut 120, and drive cone 130 in positions relative to one another. Nut 120 has two protrusions 220 that fit into slots 215 of drive cone 130.

Figure 2A:
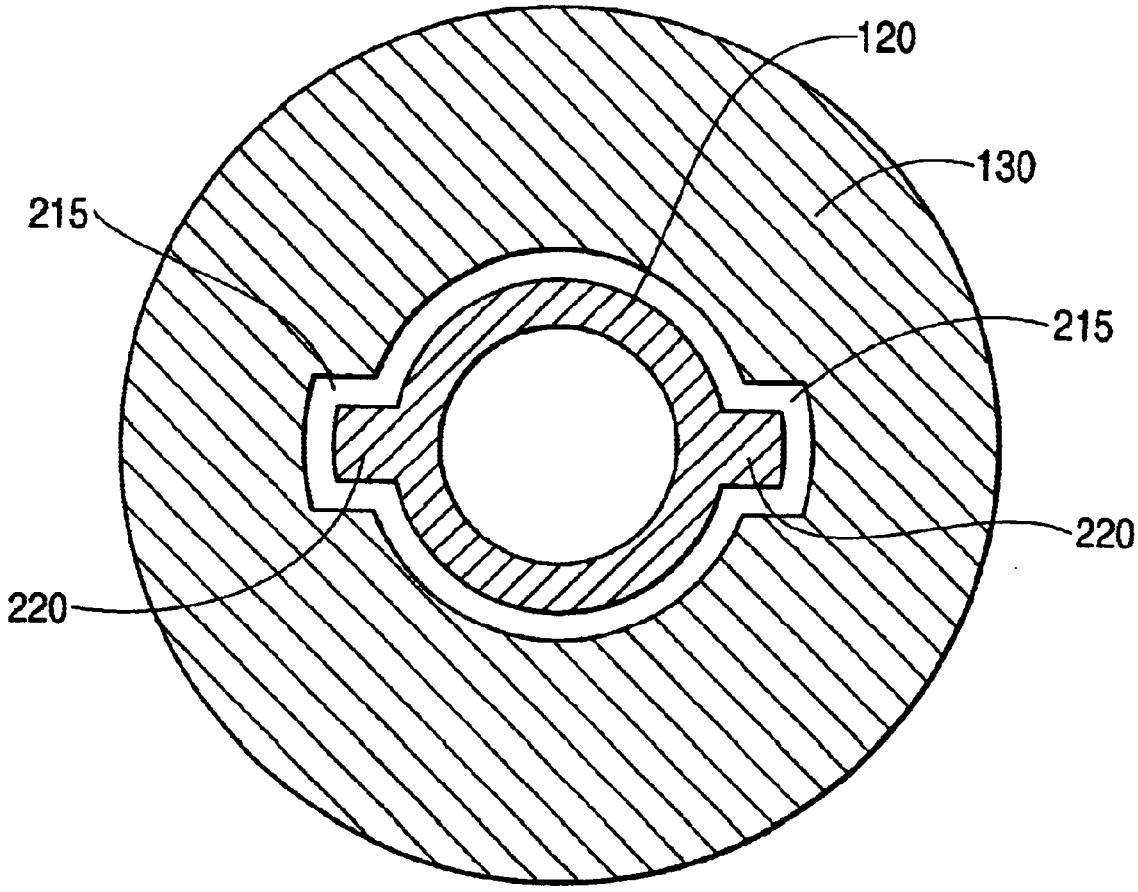
FIG. 2A is a view of a nut and a drive cone of a centrifuge as seen along line 2A—2A of FIG. 2.

FIG. 2A is a view of nut 120 and drive cone 130 as seen along line 2A—2A of FIG. 2. Protrusions 220 are confined to slots 215, and thus, rotation of nut 120 is limited with respect to drive cone 130. This arrangement of protrusions 220 and slots 215 provides for a transfer of torque from nut 120 to drive cone 130 when rotor hold-down screw 105 is being either threaded or unthreaded into nut 120.

The arrangement of rotor hold-down screw 105, nut 120 and spring 125 prevents a loosening of rotor hold-down screw 105 from nut 120 during centrifuge operation. This arrangement is particularly advantageous when the temperature or operating speed of centrifuge 100 is rapidly changed, or where rotor 135 is not balanced.

It should be understood that various alternatives and modifications of the present invention could be devised by those skilled in the art. Nevertheless, the present invention is intended to embrace all such alternatives, modifications and variances that fall within the scope of the appended claims.

What is claimed is:

1. An apparatus for securing a rotor to a drive cone in a centrifuge, said apparatus comprising:

a drive cone;

a rotor positioned upon said drive cone;

a nut, movable in an axial direction in said drive cone;

a screw for passing through a region of said rotor and for engagement with said nut; and a spring located between a surface of said nut and a surface of said drive cone, wherein said screw, when tightened into said nut, moves said nut in said axial direction to compress said spring between said surface of said nut and said surface of said drive cone.

2. The apparatus of claim 1, wherein said nut has a protrusion that fits into a slot in said drive cone to limit rotation of said nut with respect to said drive cone.

3. The apparatus of claim 1, wherein said spring comprises an element selected from the group consisting of: a double-spring washer, a compression spring, a disc spring and a belleville spring washer.

4. The apparatus of claim 1, further comprising a retaining ring for holding said nut and said spring in said drive cone, wherein said retaining ring is located adjacent to a perimeter region of said nut, within an annular groove of said drive cone.

5. An apparatus for securing a rotor to a drive cone in a centrifuge, said apparatus comprising:

a drive cone;

a rotor positioned upon said drive cone;

a nut, movable in an axial direction in said drive cone;

a screw for passing through a region of said rotor and for engagement with said nut;

a spring located between a surface of said nut and a surface of said drive cone; and a retaining ring for holding said nut and said spring in said drive cone, wherein said retaining ring is located adjacent to a perimeter region of said nut, within an annular groove of said drive cone, wherein said screw, when tightened into said nut, moves said nut in said axial direction to compress said spring between said surface of said nut and said surface of said drive cone, and wherein said nut has a protrusion that fits into a slot in said drive cone to limit rotation of said nut with respect to said drive cone.

6. A method for securing a rotor to a drive cone in a centrifuge comprising:

providing a drive cone;

positioning a rotor upon the drive cone;

providing a nut movable in an axial direction in said drive cone;

passing a screw through a region of the rotor and engaging the screw with said nut;

locating a spring between a surface of the nut and a surface of the drive cone; and tightening the screw into the nut to move the nut in said axial direction to compress the spring between said surface of the nut and said surface of the drive cone.

7. The method of claim 6, further comprising:

limiting rotation of said nut with respect to said drive cone via a protrusion located on said nut, said protrusion fitting into a slot in said drive cone.

8. The method of claim 6, wherein said spring comprises an element selected from the group consisting of: a double-spring washer, a compression spring, a disc spring and a belleville spring washer.

9. The method of claim 6, further comprising:

holding said nut and said spring in said drive cone via a retaining ring by locating said retaining ring adjacent to a perimeter region of said nut.

10. The method of claim 9, wherein the perimeter region of said nut is within an annular groove of said drive cone.

11. A method for securing a rotor to a drive cone in a centrifuge comprising:

providing a drive cone;

positioning a rotor upon the drive cone;

providing a nut movable in an axial direction in said drive cone;

passing a screw through a region of the rotor and engaging the screw with said nut;

locating a spring between a surface of the nut and a surface of the drive cone;

tightening the screw into the nut to move the nut in said axial direction to compress the spring between said surface of the nut and said surface of the drive cone;

limiting rotation of said nut with respect to said drive cone via a protrusion located on said nut, said protrusion fitting into a slot in said drive cone;

holding said nut and said spring in said drive cone via a retaining ring by locating said retaining ring adjacent to a perimeter region of said nut.

12. The method of claim 11, wherein the perimeter region of said nut is within an annular groove of said drive cone.

13. A system for securing a rotor to a drive cone in a centrifuge, said system comprising:

a drive cone;

means for holding at least one sample, said holding means positioned upon said drive cone;

means for retaining, said retaining means movable in an axial direction in said drive cone;

means for securing, said securing means passing through a region of said holding means and for engagement with said retaining means; and means for biasing located between a surface of said retaining means and a surface of said retaining means and a surface of said drive cone, wherein said securing means, when tightened into said retaining means, moves said retaining means in said axial direction to compress said biasing means between said surface of said retaining means and said surface of said drive cone.

14. The system of claim 13, wherein said retaining means has a means for stopping, said stopping means fits into a slot in said drive cone to limit rotation of said retaining means with respect to said drive cone.

15. The system of claim 14, wherein said stopping means comprises a protrusion.

16. The system of claim 13, wherein said holding means comprises a rotor.

17. The system of claim 13, wherein said retaining means comprises a nut.

18. The system of claim 13, wherein said securing means comprises a screw.

19. The system of claim 13, wherein said biasing means comprises a spring.

20. The system of claim 19, wherein said spring comprises an element selected from the group consisting of: a double-spring washer, a compression spring, a disc spring and a belleville spring washer.

* * * * *